US005180356A

United States Patent [19]

Wakabayashi et al.

[11] Patent Number: 5,180,356

[45] Date of Patent: Jan. 19, 1993

[54] CARTON BLANK ERECTER AND FEEDER

[75] Inventors: Shigeru Wakabayashi; Shoji Hirose; Shoji Nishioka; Yasuji Fujikawa, all of Tokushima, Japan

[73] Assignee: Shikoku Kakoki Co., Ltd., Tokushima, Japan

[21] Appl. No.: 811,430

[22] Filed: Dec. 23, 1991

[30] Foreign Application Priority Data

Dec. 25, 1990 [JP] Japan ..... 2-401575[U]

[51] Int. Cl.[5] ..... B31B 3/80; B31B 5/78

[52] U.S. Cl. ..... 493/316; 493/125

[58] Field of Search ..... 493/122, 125, 313, 316, 493/317

[56] References Cited

U.S. PATENT DOCUMENTS

| | | | |
|---|---|---|---|
| 3,176,978 | 4/1965 | Baker | 271/5 |
| 3,418,894 | 12/1968 | Jivoin | 493/309 |
| 3,750,931 | 8/1973 | Dick | 493/316 |
| 3,896,711 | 7/1975 | Vuilleumier | 493/316 |
| 4,512,756 | 4/1985 | Fields | 493/312 |
| 4,708,707 | 11/1987 | Koike et al. | 493/313 |
| 4,921,237 | 5/1990 | Nubson et al. | 271/11 |
| 5,007,889 | 4/1991 | Wakabayashi et al. | 493/316 |

*Primary Examiner*—William E. Terrell

*Attorney, Agent, or Firm*—Armstrong, Westerman, Hattori, McLeland & Naughton

[57] ABSTRACT

A blank feeder is used for feeding blanks to a bottom forming mandrel. The blanks are initially in a flat form and are unfoldable to a form of square cross section. The feeder includes a magazine for the flat blanks, and a transport arrangement having a path of transport extending from the delivery opening along a circular arc having a central axis parallel to the widthwise direction of the blank in the delivery opening. The transport arrangement includes a suction member, a transport arm carrying the suction member on a forward end, and a shaft rotatably supporting the transport arm and having an axis aligned with a central axis of the circular arc. The suction member has suction cups at different distances from the central axis for gripping one side of the blank, so that the blank is unfolded by movement of the suction member along the circular arc causing a greater separation of a gripped side of the blank at the furthest end of the blank from the central axis than at the nearest end of the blank. An unfolding arrangement is also provided, for unfolding each blank while the blank is being transported, the unfolding arrangement having first and second blank unfolding claws at edge portions of the delivery opening so as to individually engage with opposite ends of the blank in the delivery opening.

8 Claims, 8 Drawing Sheets

CARTON BLANK ERECTER AND FEEDER

BACKGROUND OF THE INVENTION

The present invention relates to an apparatus for use with blanks which are folded flat so as to be unfoldable to a tubular form of square cross section for feeding each of the blanks to a bottom forming mandrel by unfolding the blank to the tubular form and fitting the unfolded blank around the mandrel.

FIG. 8 shows a conventional apparatus of the type mentioned which comprises a magazine 62 having a delivery opening 61 at one end for accommodating flat blanks B as arranged side by side from the end toward the other end thereof, transport means having a path of transport extending from the delivery opening 61 as a starting end and a transport rod 64, the transport rod 64 having a suction member 63 attached to the forward end thereof and reciprocatingly movable on a straight line orthogonal to the blank B in the delivery opening 61, and means for unfolding each flat blank B to a tubular form of square cross section while the blank is being transported by the transport means, the unfolding means having first and second unfolding claws 65, 66 provided at edge portions of the delivery opening 61 so as to be individually engageable with opposite ends of the blank B in the delivery opening 61.

With the conventional apparatus, the blank B which is to be unfolded to the tubular form is likely to be bent in two in cross section instead. The cause appears to be as follows. Since the blank B moves on the straight line while being transported by the transport means, opposite ends of the blank move at the same velocity. When the blank B is delivered from the delivery opening 61, the opposite ends of the blank B move at the same speed to come into engagement with the respective unfolding claws 65, 66 at the same time, whereby the blank is unfolded to the same extent by the two claws. After the blank has been unfolded to some extent, the blank ends move out of engagement with the two claws 65, 66 at the same time, with the result that the unfolded blank B restores itself to the original flat state owing to its own repulsive force and further becomes bent to ←shape in cross section.

SUMMARY OF THE INVENTION

The main object of the present invention is to provide a blank feeder which is capable of reliably unfolding flat blanks to a tubular form of square cross section without bending the blank to the above shape.

The present invention provides a blank feeder which comprises a magazine having a delivery opening at one end and accommodating flat blanks as arranged side by side from the end toward the other end thereof, transport means having a path of transport extending from the delivery opening at a starting end to a terminal end along a circular arc having a central axis parallel to the widthwise direction of the blank in the delivery opening, and means for unfolding each blank from a flat form to a tubular form of square cross section while the blank is being transported by the transport means, the unfolding means having first and second blank unfolding claws provided at edge portions of the delivery opening so as to be individually engageable with opposite ends of the blank in the delivery opening.

With the blank feeder of the present invention, the blank moves with its opposite ends directed radially inwardly and outwardly of the circular arc while being transported on the circular arc by the transport means, so that the blank ends move at different speeds. Thus, the end remote from the central axis moves at a high velocity, and the other end close to the axis moves at a low velocity. Consequently, when the blank is withdrawn from the delivery opening, the blank ends are unfolded to different extents corresponding to the respective speeds. After the blank has been unfolded to some extent, the blank ends are disengaged from the respective claws at different times. Accordingly, the blank does not act to return to the original flat state, nor is it likely for the blank to become folded in two in cross section. The blank can therefore be unfolded to the tubular form reliably.

DESCRIPTION OF THE PREFERRED EMBODIMENT

An embodiment of the invention will be described below with reference to the drawings.

Figure 2:
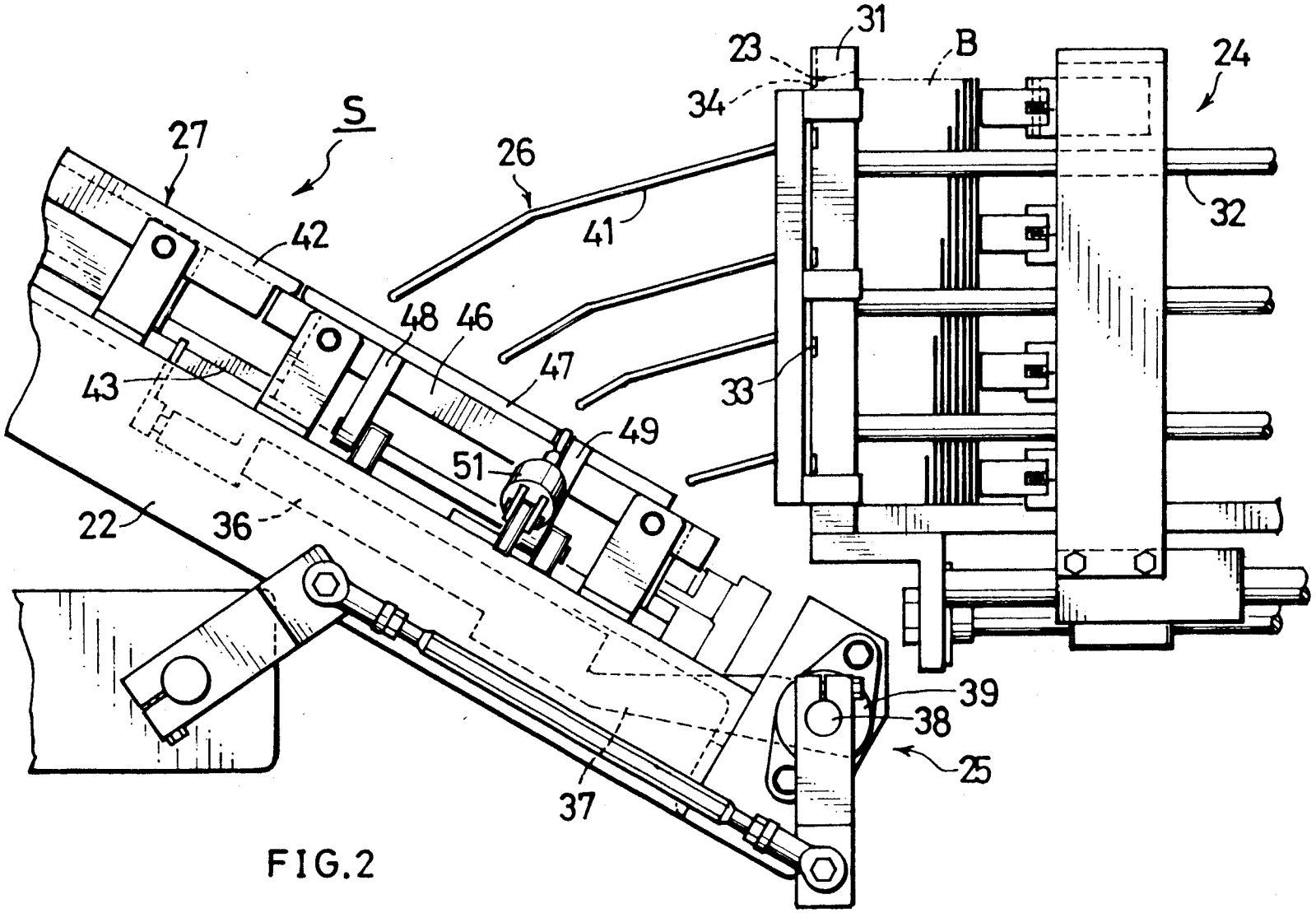
FIG. 2 is a side elevation of the feeder.
Figure 3:
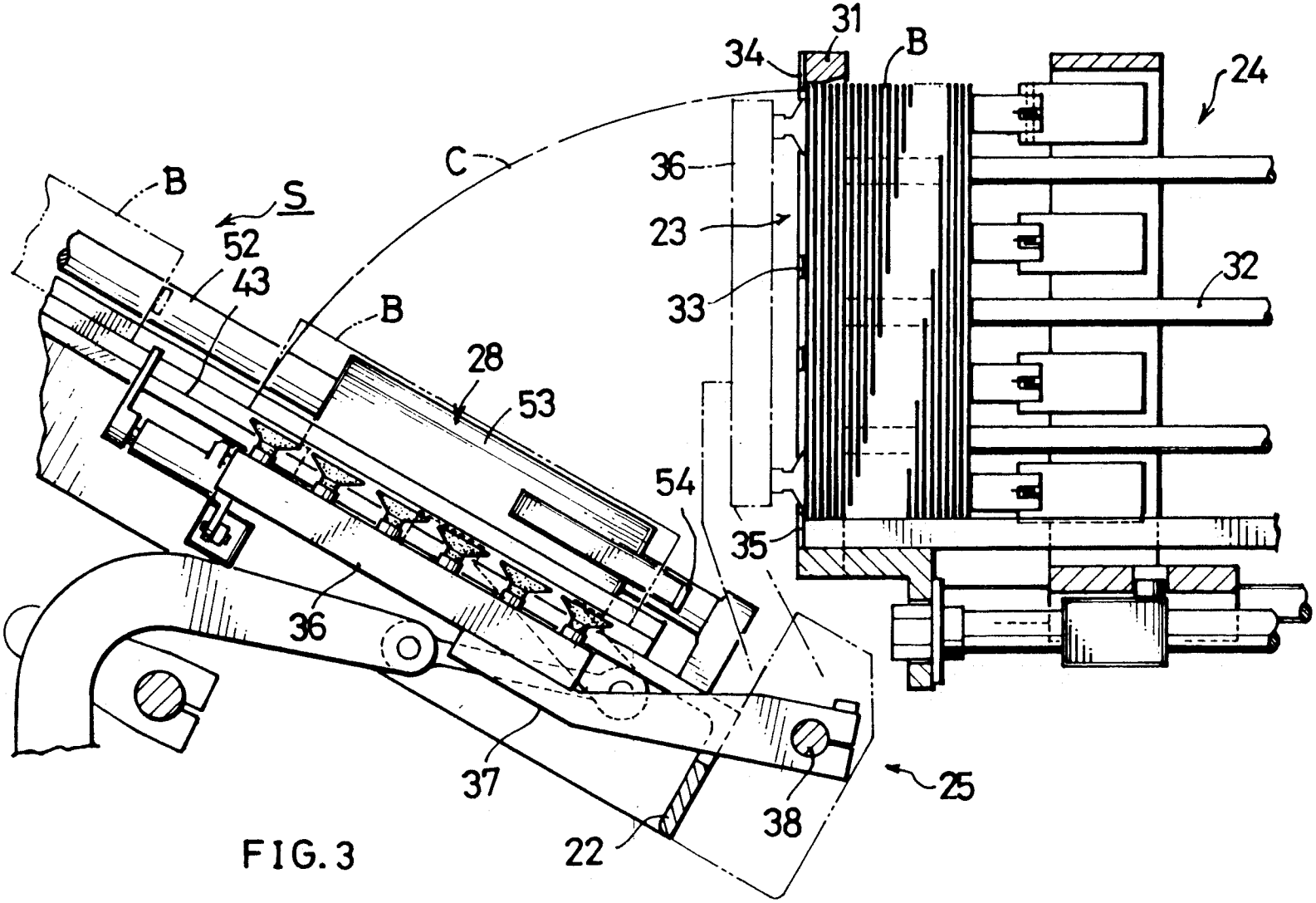
FIG. 3 is a view in vertical section of the feeder.

In the following description, the terms "inward" and "outward" are used based on FIG. 2. The left-hand side of the drawing will be referred to as "inward," and the right-hand side thereof as "outward." Further the terms "right" and "left" are used as the feeder is seen outward.

Figure 7:
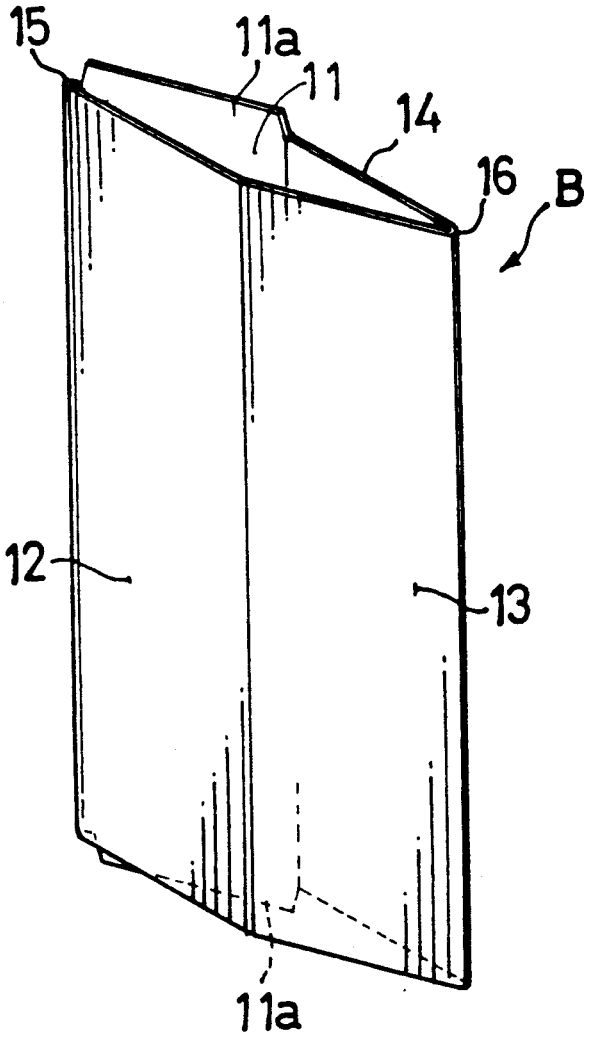
FIG. 7 is a perspective view of the blank.
Figure 8:
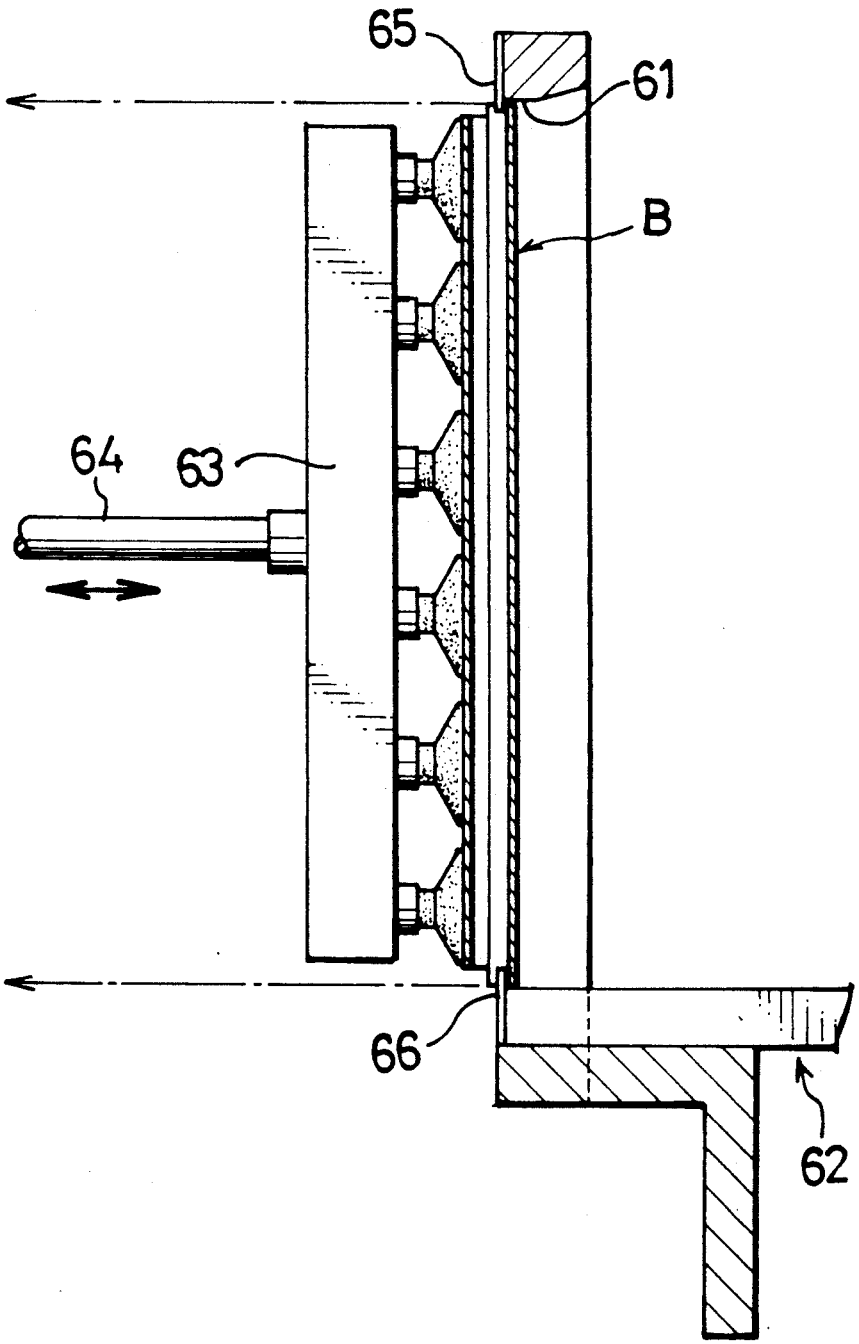
FIG. 8 PRIOR ART
FIG. 8 is a diagram corresponding to FIG. 8 and illustrating the operation of a conventional apparatus.

FIG. 7 shows a blank B having first to fourth side panels 11 to 14 which are joined to one another endlessly. The blank B is folded flat so as to be unfoldable to a tubular form of square cross section, by being bent along a first score 15 defining the first side panel 11 and the second side panel 12, and along a second score 16 defining the third side panel 13 and the fourth side panel 14. The first side panel 11 is provided at its opposite ends with engageable portions 11*a* for engagement with the blank unfolding claws to be described later. The engageable portions 11*a* project outward beyond the respective ends of the second side panel 12.

Figure 5:
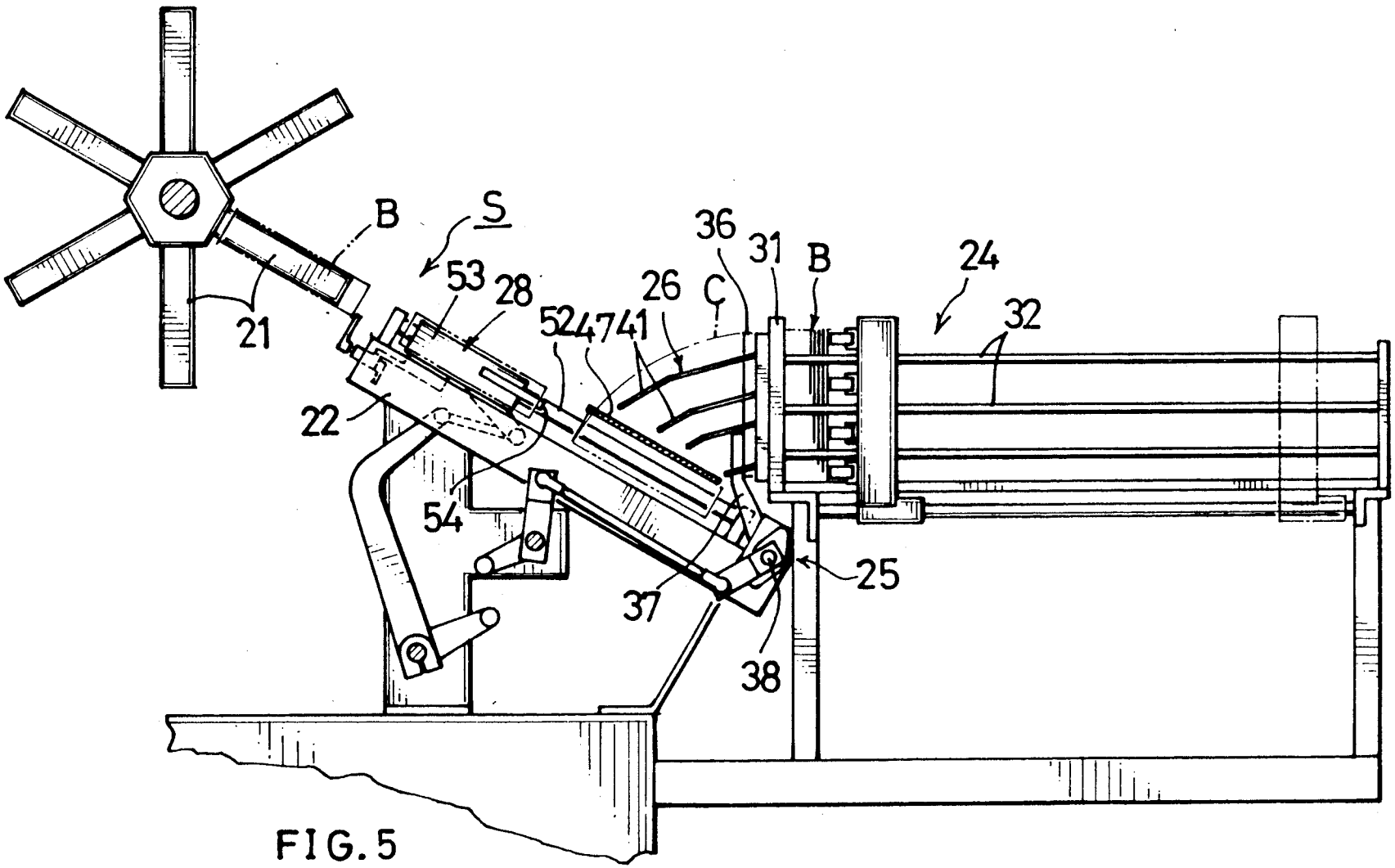
FIG. 5 is a side elevation of the feeder and mandrels.

FIG. 5 shows a blank feeder which comprises a flat box-shaped frame 22 disposed on a phantom outward extension of a blank bottom forming mandrel 21 obliquely extending outwardly downward as stopped at a feed station S, a magazine 24 disposed obliquely above the frame 22 outwardly thereof and having an inward delivery opening 23 at an inner end thereof for accommodating a multiplicity of flat blanks B as arranged closely side by side from the inner end to the outer end thereof, transport means 25 for withdrawing the blanks B from the magazine 24 one by one and transporting the blank onto the outward extension, unfolding means 26 for unfolding the flat blank B to the tubular form of square cross section while the blank is being transported by the means 25, a holder 27 for movably holding the unfolded blank B on the outward extension, and a loader 28 for fitting the blank B held by the holder 27 around the mandrels 21.

Figure 4:
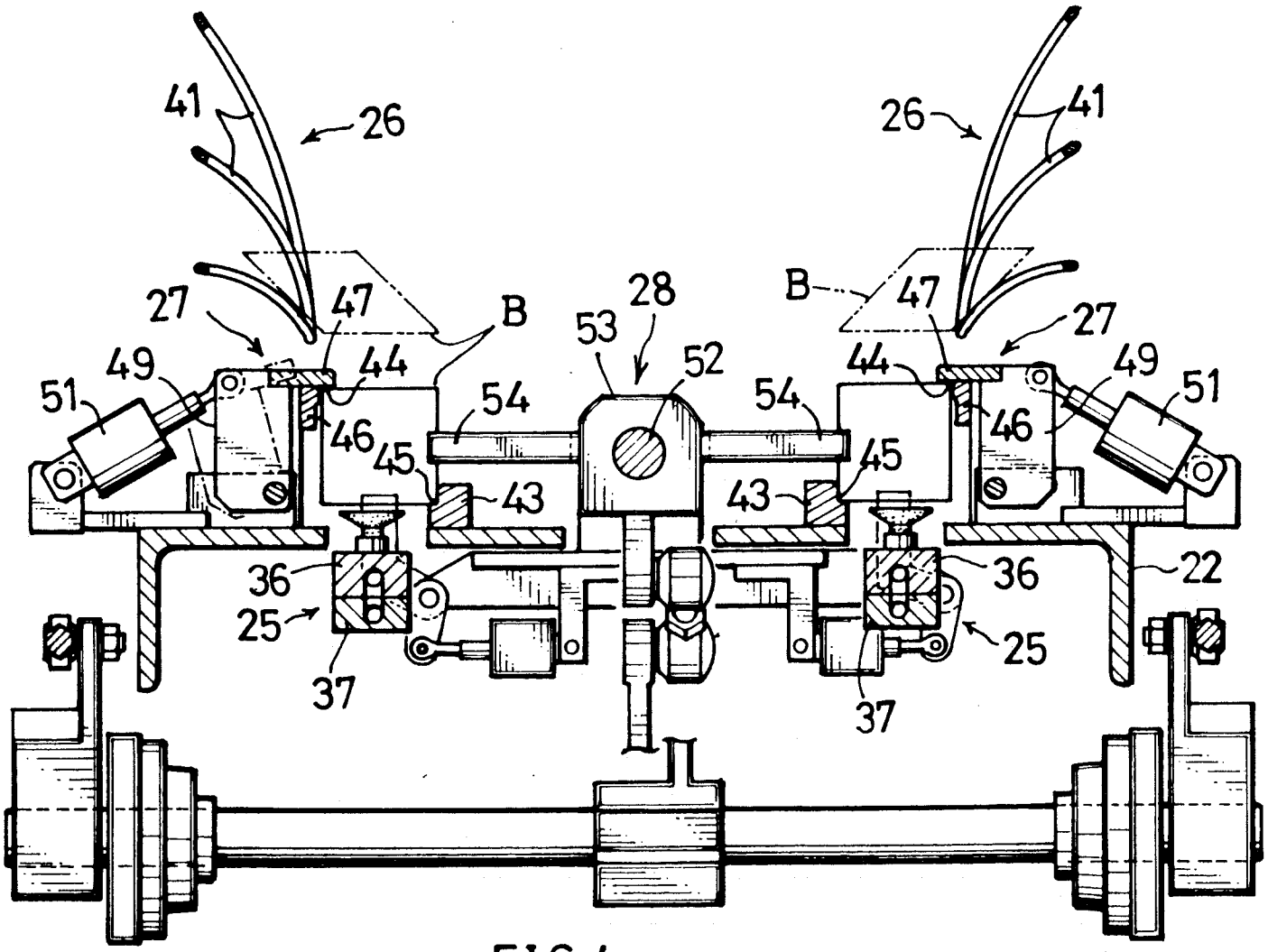
FIG. 4 is a view in cross section of the feeder.

With reference to FIG. 4, magazines 24, transport means 25, unfolding means 26 and holders 27 other than the loader 28 are provided in pairs each comprising two units of the same construction which are oriented in opposite directions transversely of the feeder. The units on the right side only will be described below.

When seen from the right side, the frame 22 has its top side inclined outwardly downward in parallel to the outward extension of the mandrel 21.

The magazine 24 comprises a vertical rectangular frame 31 defining the delivery opening 23, and a multiplicity of horizontal guide rails 32 extending outward from the frame 31. Within the magazine 24, each blank B is so positioned that the second side panel 12 and the third side panel 13 face toward the delivery opening 23, with the second side panel 12 at the left side of the third side panel 13. The left and right frame members of the frame 31 are provided with blank supports 33 for the first and second score (15, 16) portions of the blank B, i.e., the left and right edge portions thereof, to bear on. Blank unfolding claws 34, 35 for engaging the opposite ends of the blank B are attached to the respective upper and lower frame members of the frame 31.

The transport means 25 comprises a suction member 36 for attracting the second side panel 12 of the blank B within the magazine 24, a transport arm 37 having the suction member 36 attached to its forward end, and a horizontal rotatable shaft 38 having the base end of the transport arm 37 fixed thereto. The suction member 36 comprises an elongated member having a length approximately equal to the length of the blank B, and a plurality of vacuum cups arranged in a row and attached to the elongated member. The rotatable shaft 38 extends in parallel to the widthwise direction of the blank B within the delivery opening 23, is disposed below the phantom outward extension of the mandrel 21 and is supported by bearings 39 on the lower end of the frame 22 which extends transversely of the feeder, i.e., perpendicular to the extension. The right end of the shaft 38 is connected to a drive mechanism which will not be described in detail.

The unfolding means 26 comprises, besides the unfolding claws 34, 35, a plurality of bent guides 41 for guiding to the holder 27 the blank B being transported by the means 25 while pushing the second score portion 16 of the blank leftward. When seen from the right side as seen in FIG. 2, the bent guides 41 extend from locations of different levels in the vicinity of the right frame member of the magazine 24, obliquely rearwardly downward toward the holder 27. When viewed from outside as seen in FIG. 4, the guides 41 extend from the above locations downward in a bent form and terminate at a position of the same level close to the holder 41.

Figure 1:
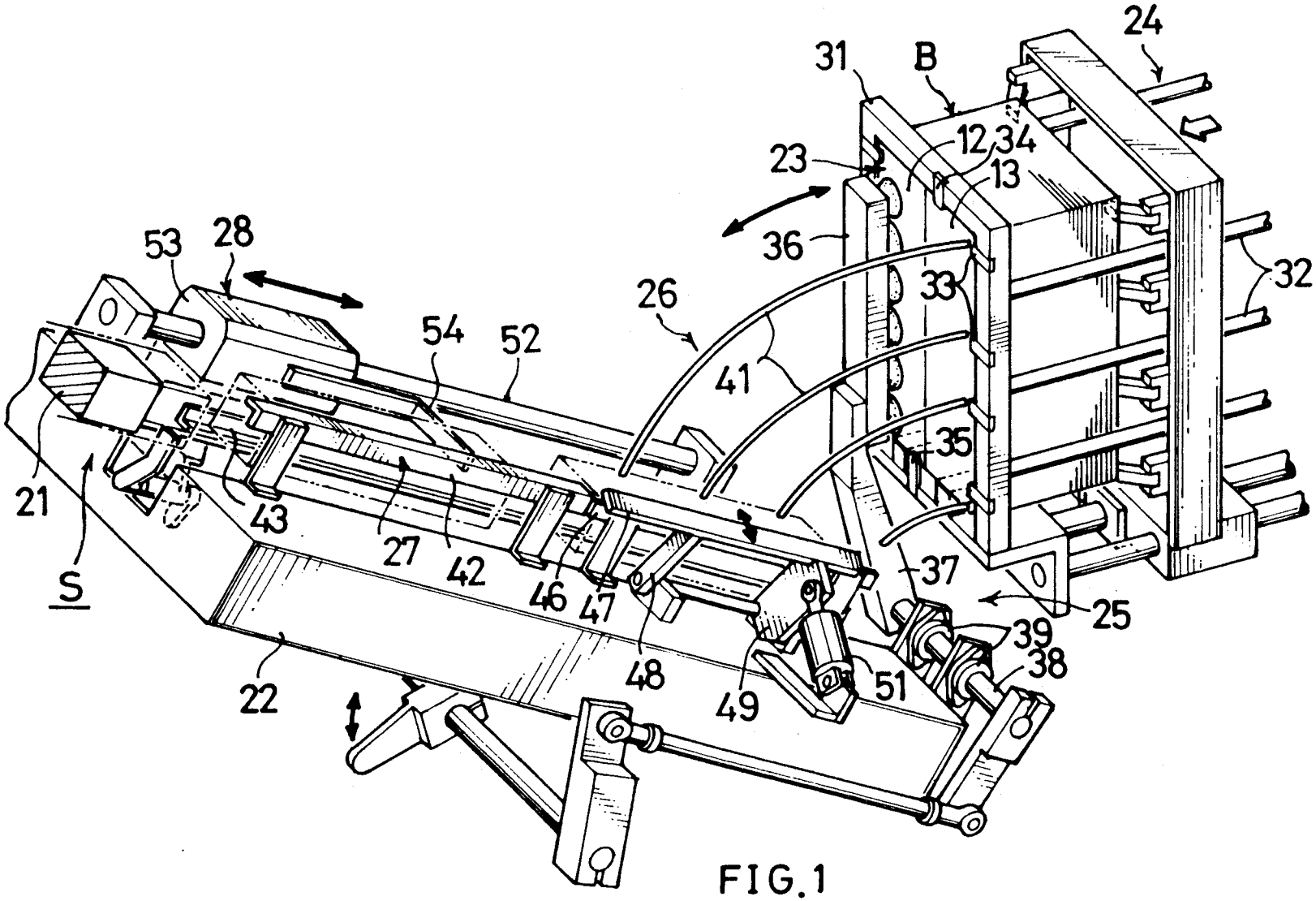
FIG. 1 is a perspective view of a blank feeder embodying the invention.

The holder 27 comprises upper and lower guide rails 42, 43 extending on opposite sides of the phantom outward extension of the mandrel 21 in parallel thereto. The guide rails 42, 43 are formed with opposed recesses 44, 45 V-shaped in cross section in conformity with the respective corners of the unfolded tubular blank B along the first and second scores 15, 16 thereof. With reference to FIGS. 1 and 4, the outer half of the upper guide rail 42 comprises a fixed member 46 and a movable member 47. The movable member 46 is pivotably supported by a rod 48 of small width and by a rod 49 of large width. The rod 49 of large width has connected thereto the piston rod of a hydraulic cylinder 51 for operating the rod 49.

When pivotally moved by the operation of the cylinder 51, the movable member 47 advances into or retracts from the path of movement of the blank B. The movable member 47 is retracted from the path immediately before the blank B is held by the holder 27 to avoid the interference of the movable member 47 with the blank B to be transported.

The loader 28 comprises a guide rod 52 extending in parallel to the outward extension of the mandrel 21 and positioned between right and left holders 27, a reciprocatingly movable member 53 slidably supported on the guide rod 52, and a blank pusher arm 54 projecting from the member 53 laterally.

When reciprocatingly moved along with the movable member 53, the pusher arm 54 pushes the blank B held by the holder 27 to a position where the blank is fitted around the mandrel 21 stopped at the blank feed station S.

Figure 6:
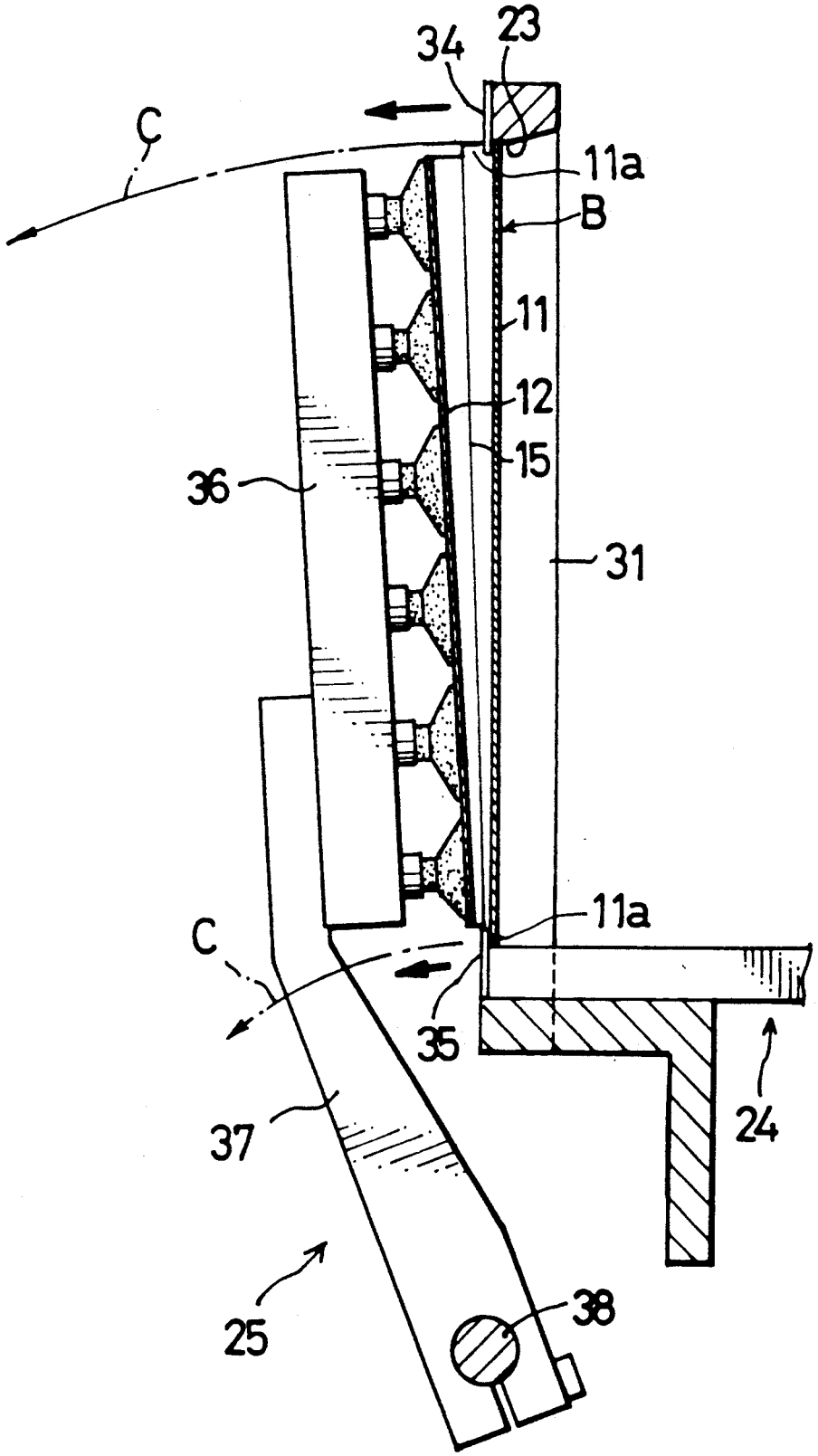
FIG. 6 is a diagram for illustrating how a blank is unfolded.

With reference to FIG. 6, a blank unfolding operation will be described next. The blank B being transported as attracted to the suction member 36 moves on a circular arc C centered about the horizontal rotatable shaft 38. Accordingly, the opposite ends of the blank B are transported at different speeds. More specifically, the speed of transport of the blank upper end is considerably greater than that of the blank lower end. When the blank B is withdrawn from the delivery opening 23 of the magazine 24, the upper and lower blank unfolding claws 35, 36 engage with the respective engageable portions 11*a* at the upper and lower ends of the blank B. The blank B is transported in this state, whereby the blank B is gradually unfolded at its opposite ends. In this case, the speed of transport of the blank B is higher at its upper end than at its lower end as stated above, so that the upper end of the blank B is opened to a greater extent than the lower end thereof. The engageable portion 11*a* at the upper end of the blank B then moves out of engagement with the upper unfolding claw 35. At this time, the blank B acts to bend to a ←shape in cross section owing to its repulsive force, whereas the engageable portion 11*a* at the lower end of the blank B remains engaged by the lower unfolding claw 36, whereby the blank B is prevented from bending. The lower-end engageable portion 11*a* of the blank B is thereafter released from the lower claw 36, permitting the blank B to be unfolded to a tubular form of square cross section.

What is claimed is:

1. A blank feeder for feeding blanks to a bottom forming mandrel, each of the blanks being folded in a flat form and being unfoldable to a tubular form of square cross section by unfolding the blank to the tubular form and fitting the unfolded blank around the mandrel, the feeder comprising:

a magazine having a delivery opening at one end and accommodating flat blanks arranged closely side by side from said one end toward the other end thereof, transport means having a path of transport extending from said delivery opening as a starting end to a terminal end along a circular arc having a central axis parallel to the widthwise direction of the blank in the delivery opening, said transport means comprising a suction member, a transport arm having said suction member attached to a forward end thereof, and a rotatable shaft rotatably supporting a base end of said transport arm, said rotatable shaft having an axis which is aligned with a central axis of said circular arc;

said suction member comprising a plurality of suction cups arranged at different distances from said central axis for gripping one side of the blank, so that unfolding of the blank by movement of said suction member along said circular arc causes a greater separation of a gripped side of the blank at the furthest end of the blank from said central axis than at the nearest end of the blank from said central axis;

unfolding means for unfolding each blank from the flat form to the tubular form while the blank is being transported by the transport means, said unfolding means having first and second blank unfolding claws disposed at edge portions of said delivery opening so as to individually engage with opposite ends of the blank in the delivery opening; and means for feeding the opened carton to a mandrel.

2. A blank feeder as defined in claim 1, wherein said terminal end of said transport path of said transport means is in alignment with an adjacent portion of the mandrel, and further comprising at said terminal end of said transport path a plurality of guide rails for guiding movement of the unfolded blank to the mandrel, said unfolding means further comprising a plurality of bent guide rails for guiding unfolding of the blank while the blank is moved from said delivery opening to said guide rails, wherein one of folded edge portions of the blank is unfolded from the flat form to the tubular form.

3. A blank feeder as defined in claim 1, wherein said magazine is so disposed as to direct said delivery opening inward and accommodate the blanks in a vertical position with the opposite ends thereof oriented upward and downward, and said rotatable shaft is orthogonal to the direction of movement of the blank along said guide rails toward the mandrel.

4. Apparatus including a plurality of blank feeders for simultaneously feeding blanks to respective bottom forming mandrels, each of the blanks being folded in a flat form and being unfoldable to a tubular form of square cross section by unfolding the blank to the tubular form and fitting the unfolded blank around the mandrel, each of said plurality of blank feeders comprising:

a magazine having a delivery opening at one end and accommodating flat blanks arranged closely side by side from said one end toward the other end thereof, transport means having a path of transport extending from said delivery opening as a starting end to a terminal end along a circular arc having a central axis parallel to the widthwise direction of the blank in the delivery opening, said transport means comprising a suction member, a transport arm having said suction member attached to a forward end thereof, and a rotatable shaft rotatably supporting a base end of said transport arm, said rotatable shaft having an axis which is aligned with a central axis of said circular arc;

said suction member comprising a plurality of suction cups arranged at different distances from said central axis for gripping one side of the blank, so that unfolding of the blank by movement of said suction member along said circular arc causes a greater separation of a gripped side of the blank at the furthest end of the blank from said central axis than at the nearest end of the blank from said central axis;

unfolding means for unfolding each blank from the flat form to the tubular form while the blank is being transported by the transport means, said unfolding means having first and second blank unfolding claws disposed at edge portions of said delivery opening so as to individually engage with opposite ends of the blank in the delivery opening; and means for feeding the opened carton to a mandrel.

5. An apparatus as defined in claim 4, wherein for each of said blank feeders, said terminal end of said transport path of said transport means is in alignment with an adjacent portion of the mandrel, and further comprising at said terminal end of said transport path a plurality of guide rails for guiding movement of the unfolded blank to the mandrel, said unfolding means further comprising a plurality of bent guide rails for guiding unfolding of the blank while the blank is moved from said delivery opening to said guide rails, wherein one of folded edge portions of the blank is unfolded from the flat form to the tubular form.

6. An apparatus as defined in claim 4, wherein for each of said blank feeders, said magazine is so disposed as to direct said delivery opening inward and accommodate the blanks in a vertical position with the opposite ends thereof oriented upward and downward, and said rotatable shaft is orthogonal to the direction of movement of the blank along said guide rails toward the mandrel.

7. An apparatus as defined in claim 4, wherein said means for feeding comprises a loader for simultaneously loading a plurality of blanks disposed at said guide rails onto respective mandrels.

8. An apparatus as defined in claim 7, wherein said loader comprises a guide rod, a pusher member movable along and guided by said guide rod, and a plurality of blank pusher arms extending from said pusher member, each of said plurality of blank pusher arms being engageable with a different one of the blanks, for simultaneously pushing a plurality of blanks along said guide rails onto respective mandrels.

* * * * *